US011648609B1

(12) United States Patent
Wang

(10) Patent No.: US 11,648,609 B1
(45) Date of Patent: May 16, 2023

(54) DIE-CASTING DIE, DIE-CASTING DEVICE AND ULTRA-HIGH SPEED DIE-CASTING METHOD

(71) Applicant: Shenghua Wang, Fujian (CN)

(72) Inventor: Shenghua Wang, Fujian (CN)

( * ) Notice: Subject to any disclaimer, the term of this patent is extended or adjusted under 35 U.S.C. 154(b) by 0 days.

(21) Appl. No.: 17/717,719

(22) Filed: Apr. 11, 2022

(30) Foreign Application Priority Data

Jan. 20, 2022 (CN) ..... 202210067329.4

(51) Int. Cl.
*B22D 17/22* (2006.01)
*B22D 17/08* (2006.01)

(52) U.S. Cl.
CPC ..... *B22D 17/2272* (2013.01); *B22D 17/08* (2013.01); *B22D 17/2209* (2013.01)

(58) Field of Classification Search
CPC ..... B22D 17/2272; B22D 17/2281; B22D 17/229
See application file for complete search history.

(56) References Cited

U.S. PATENT DOCUMENTS 4,347,889 A * 9/1982 Komatsu ..... B22D 17/30 164/113
4,828,006 A * 5/1989 Vander Jagt ..... B22C 9/046 164/255
6,467,527 B1 * 10/2002 Kubota ..... B22D 17/08 164/133
2002/0005233 A1 * 1/2002 Schirra ..... C22C 1/02 148/428

FOREIGN PATENT DOCUMENTS

CN 110512173 A * 11/2019
CN 112453345 A * 3/2021
KR 10-1375642 B1 * 3/2018

* cited by examiner

*Primary Examiner* — Kevin E Yoon
*Assistant Examiner* — Jacky Yuen
(74) *Attorney, Agent, or Firm* — Cooper Legal Group, LLC

(57) ABSTRACT

Disclosed are a die-casting die, a die-casting device and an ultra-high speed die-casting method. The die-casting die comprises a die body, the die body is arranged with a feed port, a pouring potion and a cavity portion, the pouring potion is arranged with a pouring runner communicating to the feed port, and the cavity portion is arranged with a molding cavity; the die body is arranged with a gate portion between the cavity portion and the pouring potion, the gate portion is arranged with an ingate runner communicating the molding cavity and the pouring runner, the ingate runner is a plurality of ingate runners, and each ingate runner is arranged in sequence in the width direction of a side of the gate portion facing the molding cavity; a communicating position between the ingate runner and the molding cavity is an ingate.

7 Claims, 12 Drawing Sheets

DIE-CASTING DIE, DIE-CASTING DEVICE AND ULTRA-HIGH SPEED DIE-CASTING METHOD

CROSS-REFERENCE TO RELATED APPLICATION

This application claims the priority to Chinese patent application No. 202210067329.4, filed on Jan. 20, 2022. The entirety of the above-mentioned patent application is hereby incorporated by reference herein and made a part of this specification.

TECHNICAL FIELD

The present application relates to the technical field of metal die-casting, and in particular to, a die-casting die, a die-casting device and an ultra-high speed die-casting method.

BACKGROUND ART

In the existing technology, a die-casting machine and a die-casting die arranged on the die-casting machine are usually used for die-casting of metal parts. The metal liquid is pushed into the die-casting die by the die-casting machine at a specified speed. The die-casting die is provided with a pouring runner and a molding cavity, the pouring runner is communicated with the molding cavity via an ingate. The metal liquid passes through the pouring runner and enters into the molding cavity through an ingate.

The speed at which the metal liquid enters into the molding cavity through the ingate is a filling speed of the ingate, which is also referred to as a gate speed. The molding of metal liquid in the molding cavity is directly affected by the gate speed. If the filling speed is too low, the metal liquid will not be atomized, resulting in poor filling. In the existing technology, the gate speed is adjusted by a pushing speed adjustment of the die-casting machine. However, the die-casting machine has a preset and limited range of the device conditions. When the conditions of pushing speed reach the limit, the gate speed will also reach the upper limit. At this time, how to improve the gate speed of the die-casting die is a technical solution that needs to be solved by those skilled in the art.

SUMMARY

In order to increase the gate speed, the present application provides a die-casting die, a die-casting device and an ultra-high speed die-casting method.

In the first aspect, the present application provides a die-casting die, which adopts the following technical solution:

a die-casting die includes a die body, wherein the die body is provided with a feed port, a pouring potion and a cavity portion, the pouring potion is provided with a pouring runner communicating with the feed port, and the cavity portion is provided with a molding cavity; and wherein a gate portion is provided between the cavity portion and the pouring potion of the die body, the gate portion is provided with a plurality of ingate runners communicating with the molding cavity and the pouring runner, and the plurality of ingate runners are arranged in sequence in a width direction of a side of the gate portion facing the molding cavity; ends of the ingate runners at which the ingate runners communicate with the molding cavity constitute an ingate.

Different from the traditional design in the existing technology that the die-casting die is one pouring runner corresponding to one or more gate portions, and each gate portion only corresponds to one ingate runner. In this present application, the die-casting die is arranged as a structure in which one pouring runner corresponds to one or more gate portions, and each gate portion corresponds to a plurality of ingate runners. That is, the side of the gate portion facing the molding cavity is divided in the width direction perpendicular to the pouring direction, to reduce the cross-sectional area of the ingate facing the molding cavity. Under the same punch pin filling conditions, it can have a higher gate speed than the die-casting die of existing technology, to improve the filling pressure of metal liquid injecting into the molding cavity from the ingate, further to improve the gate speed of the ingate.

In the second aspect, the present application provides a die-casting device, which adopts the following technical solution:

a die-casting device includes a die-casting machine and the above mentioned die-casting die, the die-casting machine comprises an injection mechanism for pushing metal liquid into the die-casting die at a specified speed; the injection mechanism comprises a barrel and a punch pin arranged in the barrel; the barrel is provided with a feed end for feeding metal liquid and a discharge end for discharging metal liquid; the punch pin is configured for pushing metal liquid; the feed port of the die-casting die communicates with the discharge end of the barrel.

By the high-speed and fast injection function of the die-casting machine, the metal liquid can be instantaneously and rapidly pressurized to fill the die-casting die, to improve the pressure effect, so that the pressure can act on the molding cavity of the whole die-casting die, to improve the molding air tightness and molding stability in the molding cavity.

In the third aspect, the present application provides an ultra-high speed die-casting method, which adopts the following technical solution:

an ultra-high speed die-casting method for die casting with the above mentioned die-casting device includes the following steps:

preheating the die-casting die;

pouring the molten metal liquid into the barrel of the die-casting machine, and a pushing speed of the punch pin is less than 0.7 m/s; vacuumizing the die-casting die when the punch pin is pushed to block the feed end of the barrel; at the same time, continuing to push the metal liquid to fill the gate portion of the die-casting die;

increasing the pushing speed of the punch pin instantly when filling the metal liquid into the gate portion of the die-casting die, the pushing speed of the punch pin of the die-casting machine is 1-8 m/s;

pushing the metal liquid to spray the metal liquid into the molding cavity from the gate portion in a form of atomization, and a gate speed is 65-120 m/s;

after the filling of the molding cavity is completed, reducing the pushing speed of the punch pin and pressurizing the die-casting machine to 70-100 MPa; and cooling, molding and demoulding to obtain a required metal die casting.

By the ultra-high speed die-casting method, the metal liquid is pushed at a low speed in the early stage to make the metal liquid flow to the gate portion at a steady and uniform speed, and the fluctuation and air entrainment of the metal liquid can be reduced in the process; at the same time, when the metal liquid is filled to the gate portion, it will be pressurized instantaneously to reduce the pressure loss when the metal liquid does not reach the gate portion, to improve the direct effect of the pressure at the gate portion, the pressure effect of the metal liquid injecting into the molding cavity from the ingate of the gate portion, and the gate speed, to achieve the effect of ultra-high speed atomization filling; in the later stage of filling, the pushing speed is decelerated, which is conducive to reduce the excessive overflow, flash and other die-casting defects caused by the continuous high-pressure filling of molten liquid, to improve the die-casting effect.

To sum up, the present application includes at least one of the following beneficial technical effects:

1. the design of a plurality of ingate runners is adopted, reducing the cross-sectional area of the ingate facing the molding cavity, greatly improving the gate speed of the die-casting die; the gate speed can reach 65-120 m/s, the filling time is as low as 0.006-0.08 t/s; the filling pressure is large, which can realize ultra-high-speed die-casting with the gate speed greater than 60 m/s and improve the filling effect of metal liquid; the metal liquid is sprayed into the molding cavity in the form of atomization, and the residual air in the molding cavity is broken into fine bodies, to fully compress the pores of the metal forming parts obtained by die-casting, and the pore volume ratio is compressed to 0.01%, to homogenize the metallographic structure and improve the molding effect of the metal parts, it is especially convenient to make metal products with high requirements such as porosity less than 0.2%, dense surface and high finish, or T6 treatment.

2. An acceleration portion is arranged between the pouring potion and the gate portion of the die-casting die. The acceleration slot with first descending and then ascending is arranged in the acceleration portion improving the filling speed and filling pressure of the metal liquid to the gate portion, further to improve the gate speed of the die-casting die and be used for die-casting of ultra-thin parts below 0.8 mm.

3. The method of instantaneous pressurization filling is adopted to reduce the pressure loss in the early stage, to improve the direct effect of pressure on the gate portions, the pressure effect of metal liquid injecting into the molding cavity from the ingate of the gate portions, and the gate speed, to achieve the effect of ultra-high speed atomization filling.

BRIEF DESCRIPTION OF THE DRAWINGS

In particular, FIGS. 12-14 are views observed at 500 times magnification of a metallographic electron microscope.

DETAILED DESCRIPTION

The present application is described in further detail below with references to FIGS. 1-14.

Embodiment 1

Figure 1:
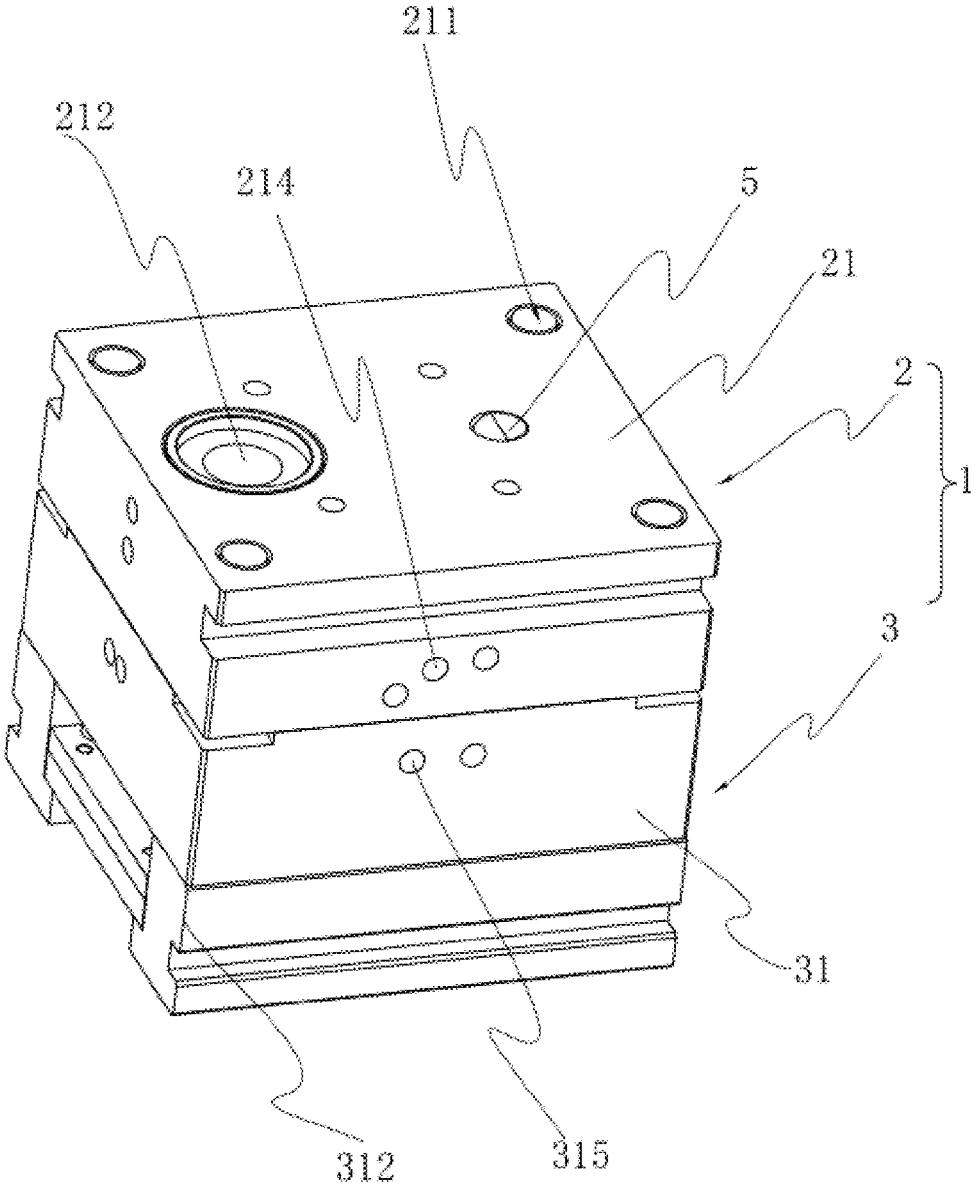
FIG. 1 is a schematic diagram of an overall structure of a die-casting die according to Embodiment 1 of the present application.

Referring to FIG. 1, a die-casting die includes a die body 1. The die body 1 includes a fixed die module 2 and a moving die module 3 for opening and closing with the fixed die module 2.

Figure 2:
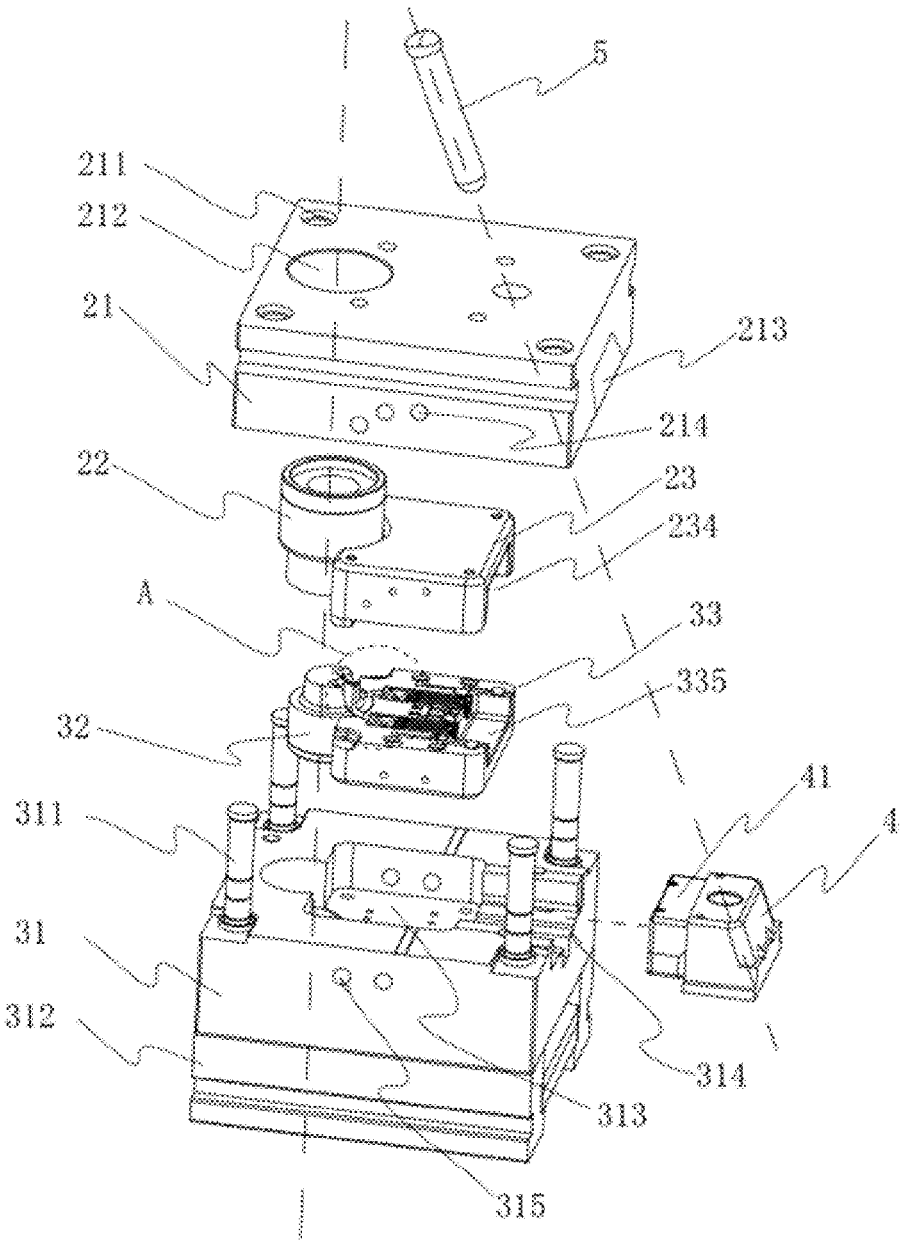
FIG. 2 is a schematic structural exploded diagram of the die-casting die according to Embodiment 1 of the present application.

Referring to FIGS. 1 and 2, the moving die module 3 includes a moving die frame 31. The moving die frame 31 is provided with guide pillars 311 for slidably connecting with the fixed die module 2. A die base 312 is provided on a side of the moving die frame 31 away from the fixed die module 2, and the moving die frame 31 is fixedly arranged on a die-casting machine used with the die-casting die by means of the die base 312.

Figure 3:
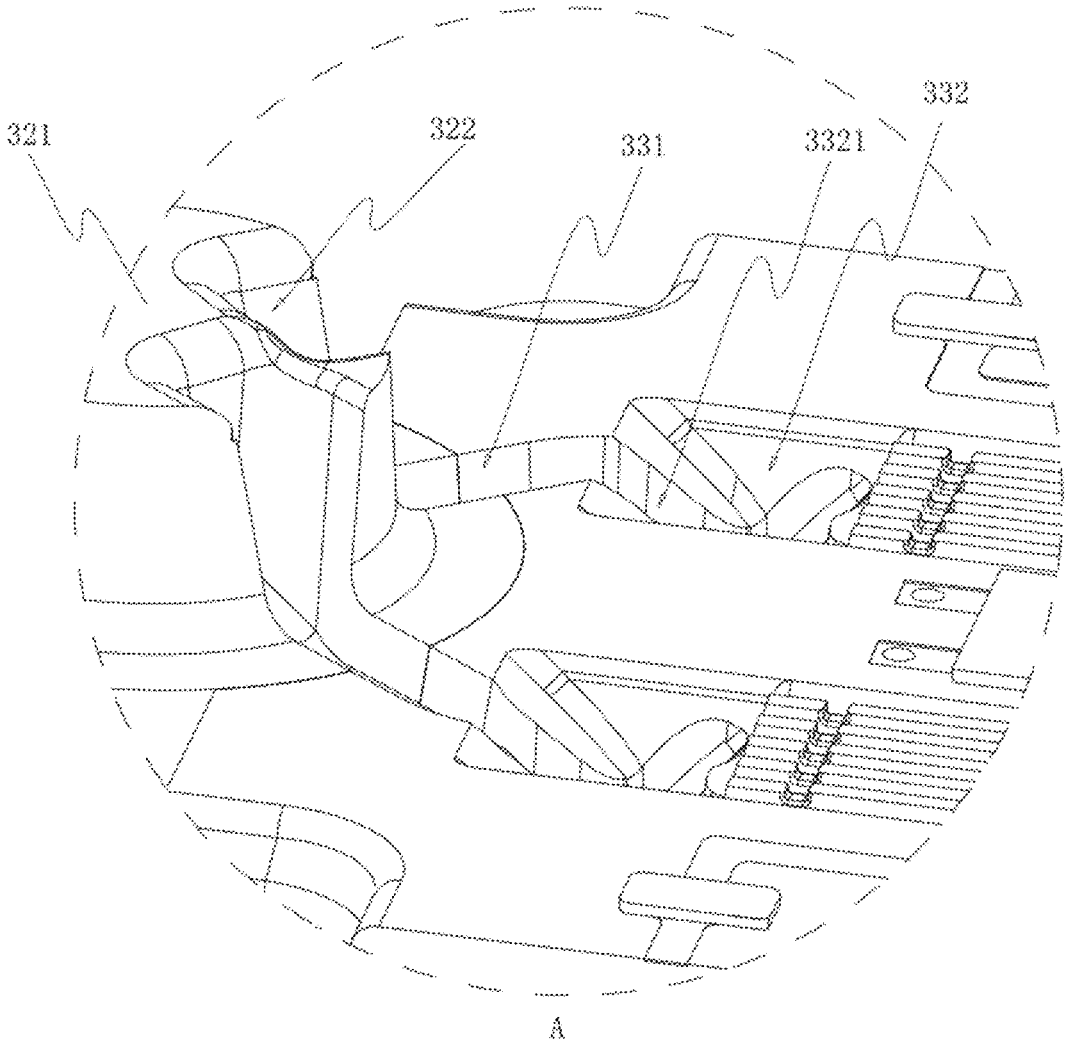
FIG. 3 is an enlarged view of a portion A in FIG. 2.

Referring to FIGS. 2 and 3, a moving die mounting slot 313 is formed on a side of the moving die frame 31 facing the fixed die module 2. A sprue spreader 32 and a moving die core 33 are arranged in the moving die mounting slot 313. A side wall of the moving die core 33 abuts against a circumferential side wall of the sprue spreader 32. One side of the sprue spreader 32 facing the fixed die module 2 protrudes upwards to form a sprue spreader frustum 321. A sprue spreader slot 322 for dividing metal liquid is formed on a side of the sprue spreader frustum 321 facing the moving die core 33. A moving die pouring runner 331 communicating with the sprue spreader slot 322 is formed on a side of the moving die core 33 close to the sprue spreader 32. The moving die pouring runner 331 extends obliquely downward in a pouring direction. The number of moving die pouring runners 331 corresponds to the number of the sprue spreader slot 322 one by one. A moving die acceleration cavity 332 is provided on the moving die core 33 at one end of each moving die pouring runner 331 away from the sprue spreader 32. A moving die acceleration slot 3321, communicating with a corresponding moving die pouring runner 331, is provided at bottom of each moving die acceleration cavity 332. The moving die acceleration slot 3321 firstly descends and then goes up in the pouring direction. When the die-casting die is clamped for die casting, the metal liquid flows through the sprue spreader 32, the moving die pouring runner 331 and the moving die acceleration slot 3321. Due to the downward extension of the moving die pouring runner 331 and the descending and going up of the moving die acceleration slot 3321, the metal liquid may form a U-shaped communicating portion in the pouring direction. By means of a characteristic that the liquid pressure on both sides of the U-shaped communicating portion is balanced, the pressure transmission effect of metal liquid in the pouring direction can be enhanced and the pouring speed of metal liquid can be increased.

Figure 4:
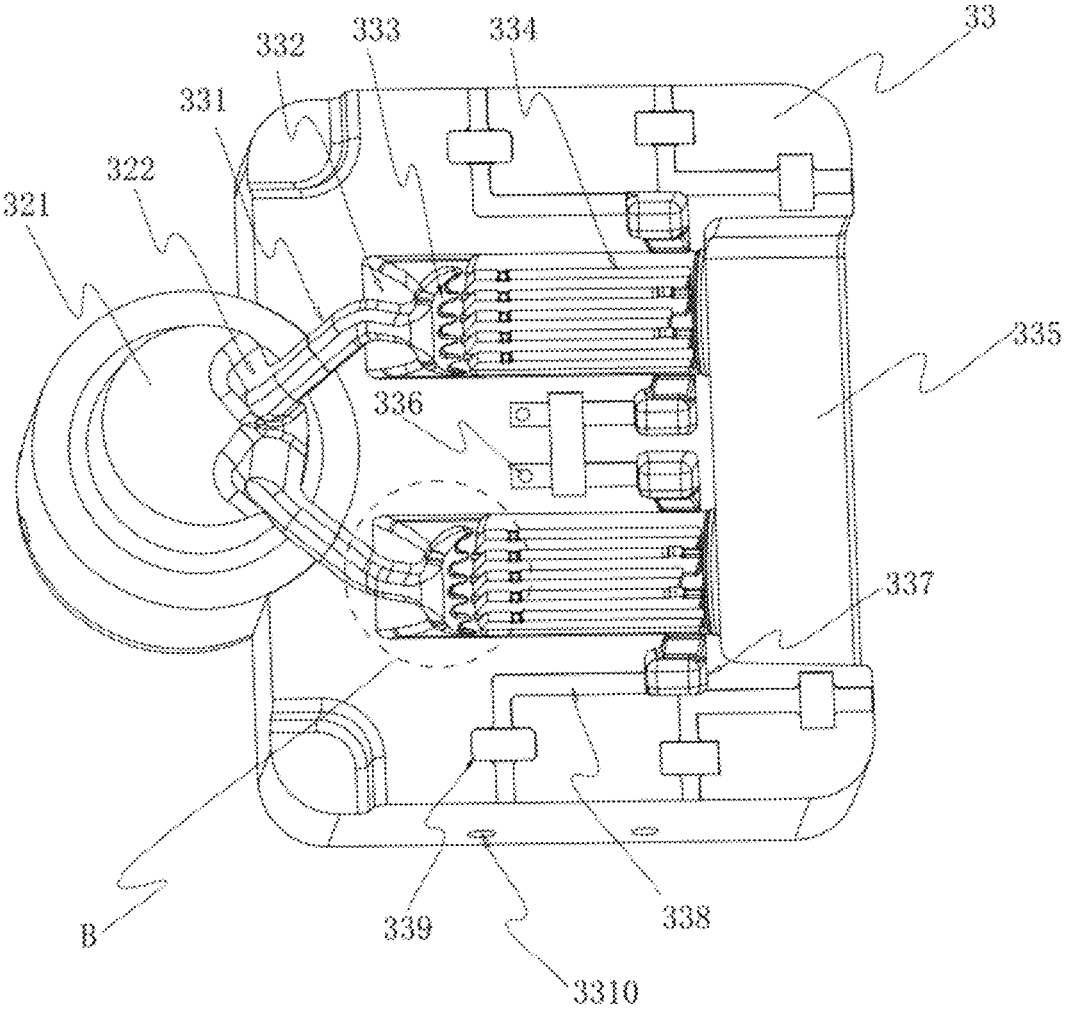
FIG. 4 is a schematic structural diagram of a moving die core according to Embodiment 1 of the present application.
Figure 5:
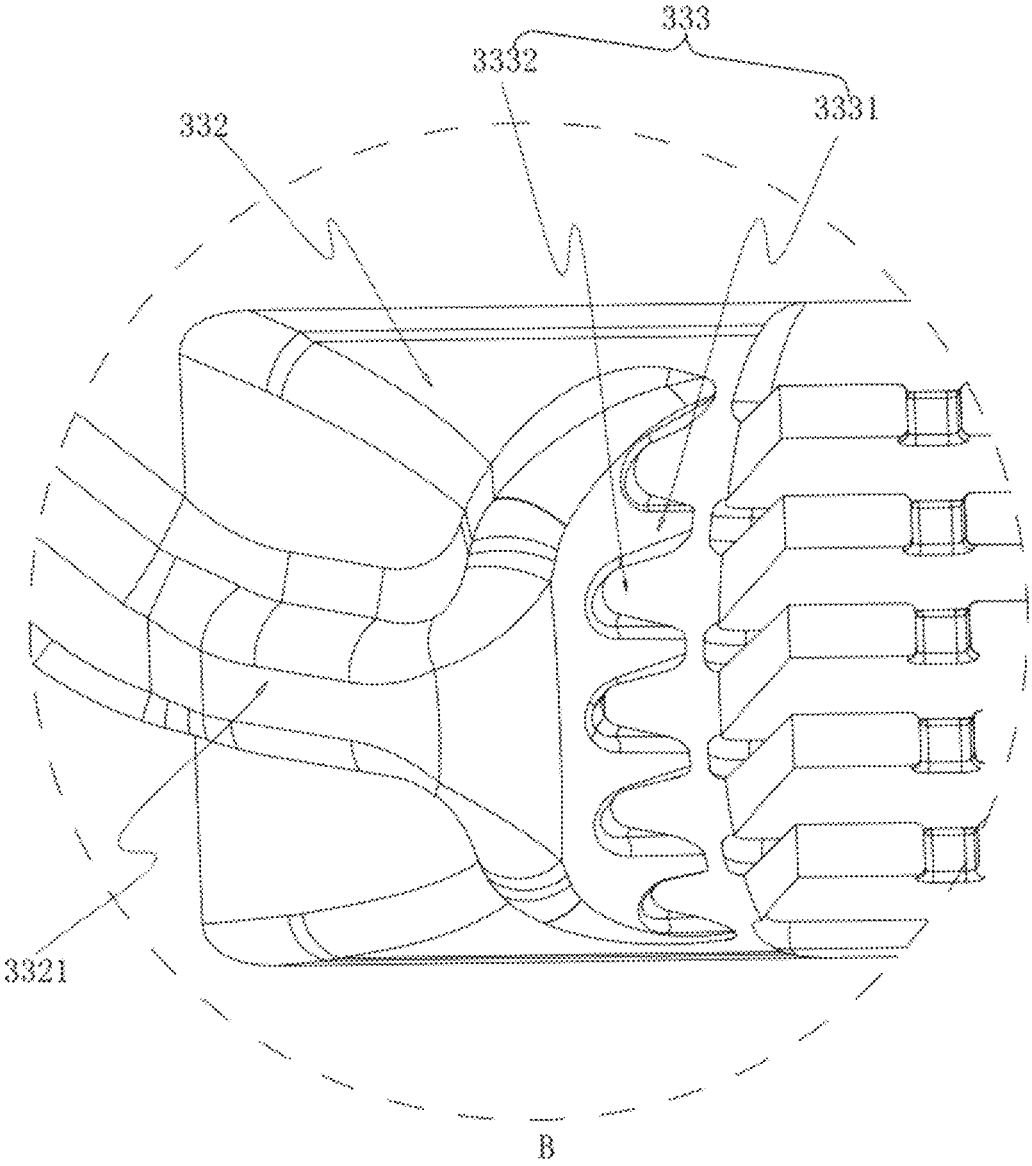
FIG. 5 is an enlarged view of a portion B in FIG. 4.

Referring to FIGS. 4 and 5, on the moving die core 33, a moving die gate portion 333 and a moving die cavity 334 are provided on a side of each moving die acceleration cavity 332 away from the moving die pouring runner 331 successively in the pouring direction. A plurality of moving die ingate notches 3331 are formed on the moving die gate portion 333, and the moving die ingate notches 3331 are arranged successively in a width direction of a side of the moving die gate portion 333 facing the moving die cavity 334. The moving die ingate notches 3331 communicate with the moving die acceleration slot 3321 and the moving die cavity 334. The diameter of the moving die ingate notches 3331 gradually decreases in the pouring direction. When the metal liquid flows through the moving die ingate notches 3331 and enters the moving die cavity 334, the gradually decreased diameter can enhance the concentrated pressure effect of the metal liquid in the moving die ingate notches 3331, increase the filling pressure of the metal liquid, and increase the gate speed.

Referring to FIGS. 4 and 5, a moving die guide head 3332 is arranged on the moving die gate portion 333 between two adjacent moving die ingate notches 3331. The moving die guide heads 3332 protrude towards the moving die accelerating slot 3321 to form an arc-shaped heads. The moving die guide head 3332 conforms to the pouring direction of the metal liquid, which can effectively reduce the flow resistance of the moving die gate portion 333 to the metal liquid, increase the speed at which the metal liquid enters into the moving die cavity 334 through the moving die ingate notch 3331 and the gate speed.

Referring to FIGS. 2 and 4, on the moving die core 33, a moving die limit slot 335 is provided on a side of the moving die cavity 334 away from the moving die gate portion 333. The moving die limit slot 335 communicates with the moving die cavity 334. A moving die sliding slot 314 is provided on the moving die frame 31, which communicates with the moving die limit slot 335. A sliding table 4 is slidably arranged on the moving die sliding slot 314, and a limiting table 41 is arranged on a side of the sliding table 4 facing the moving die cavity 334. When the moving die module 3 and the fixed die module 2 are clamped together, the sliding table 4 slides towards the moving die cavity 334, and the limiting table 41 abuts against the moving die limit slot 335 for sealing one side of the moving die cavity 334. When the moving die module 3 and the fixed die module 2 are separated, the sliding table 4 slides away from the moving die cavity 334, and the limiting table 41 is separated from the moving die limit slot 335, which facilitates the demoulding of the metal molding parts in the moving die cavity 334. The sliding table 4 is used for the installation of the die casting die to a die-casting machine.

Referring to FIGS. 2 and 4, a vacuum hole 336 is provided through the moving die core 33, which is used for communicating and installing of a vacuum equipment with the die-casting die, and is used for vacuum pumping and exhausting. The moving die frame 31 is provided with a connecting hole communicating with the vacuum hole 336 (not shown in the drawings).

Referring to FIGS. 2 and 4, on the moving die core 33, an overflow groove 337 is provided on a side of the moving die cavity 334 away from the moving die gate portion 333, and an exhaust groove 338 is provided on a side of the overflow groove 337 away from the moving die cavity 334. The exhaust groove 338 communicates with the vacuum hole 336. The exhaust groove 338 is used to guide gas discharge during vacuum pumping and exhausting, so as to improve the guidance of gas extraction and discharge of metal liquid in the moving die cavity 334 and reduce the defects of forming pores and the probability of blockage of the vacuum hole 336 caused by the metal liquid flowing with the gas. A filter block 339 is arranged on an exhaust path of the exhaust groove 338, which is located between the vacuum hole 336 and the overflow groove 337. The filter block 339 is a microporous metal sintered block. The filter block 339 is used for metal liquid interception and ventilation to reduce the metal flow channeling.

Referring to FIGS. 2 and 4, a moving die cooling communicating groove 3310 is provided on the moving die core 33, which penetrates through the moving die core 33. A moving die cooling port 315, communicating with the moving die cooling communicating groove 3310, is provided on the moving die frame 31. The moving die cooling port 315 is used for the installation of a cooling device on the die-casting die. The cooling device can be a cold water circulation system or a cold air circulation system, as long as it can be used for cooling. By the moving die cooling communicating groove 3310, the moving die cavity 334 of the moving die core 33 can be cooled comprehensively and rapidly, so as to improve the die casting.

Figure 6:
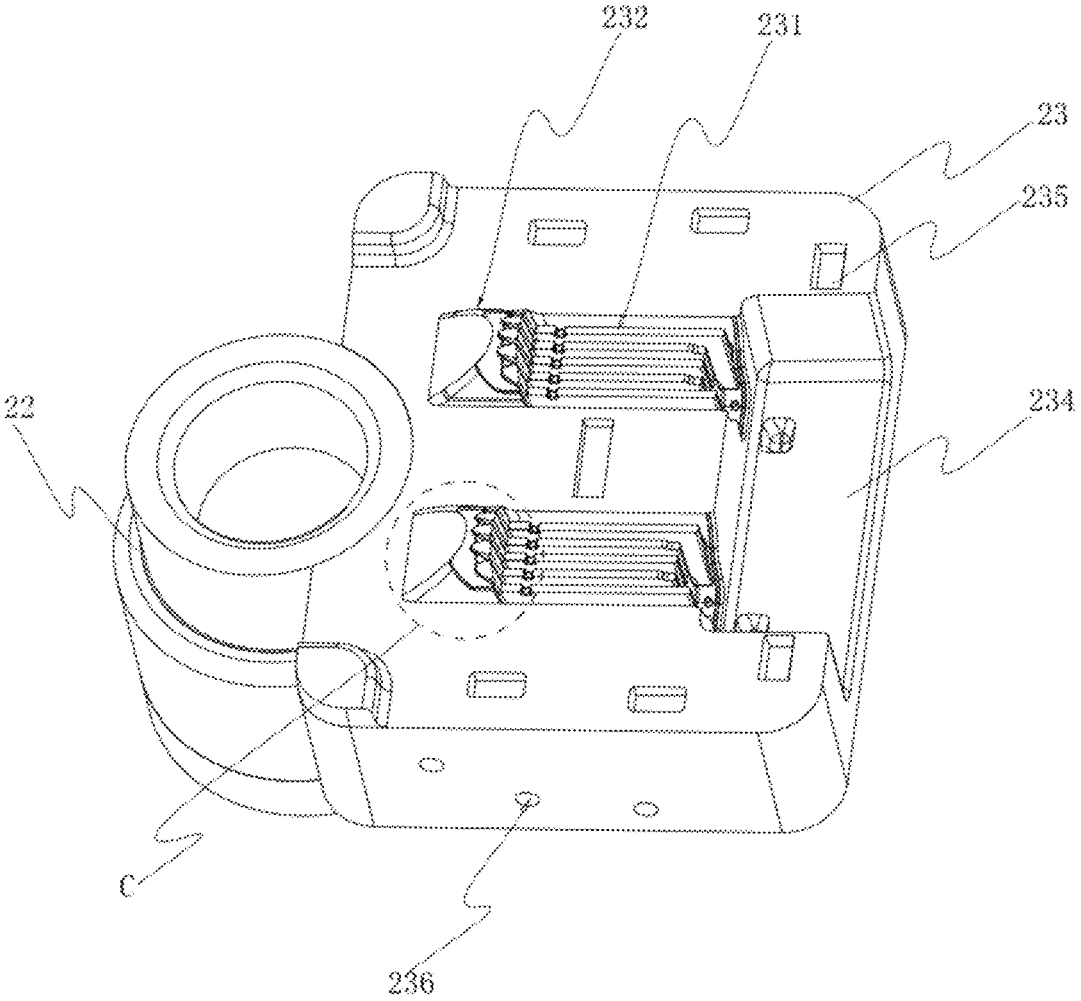
FIG. 6 is a schematic structural diagram of a fixed die core according to Embodiment 1 of the present application.
Figure 7:
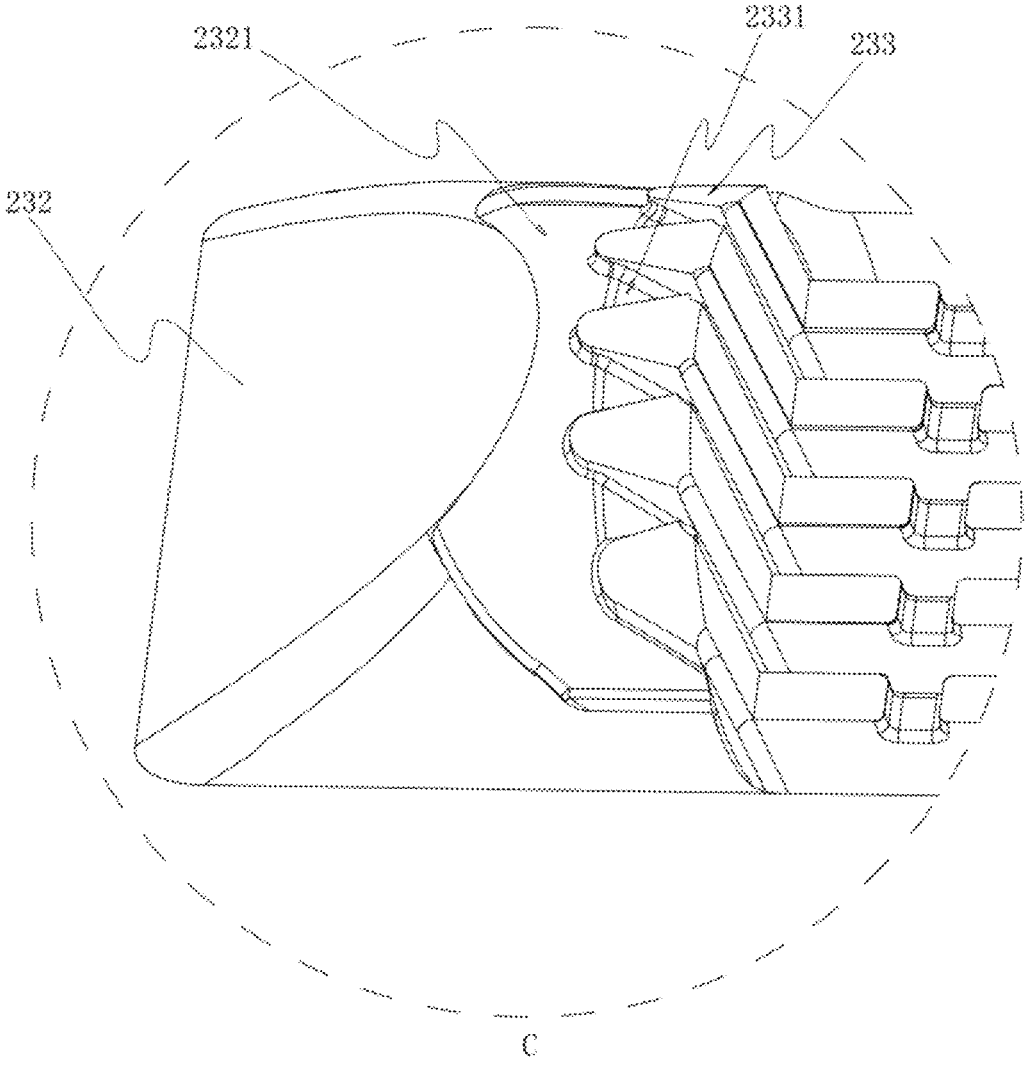
FIG. 7 is an enlarged view of a portion C in FIG. 6.

Referring to FIGS. 2, 6 and 7, the fixed die module 2 includes a fixed die frame 21 for fixed installation of a die-casting die to a die-casting machine. A guide sleeve 211 for slidably connecting with the guide pillar 311, a pouring sleeve 22 for sleeving on the sprue spreader 32, and a fixed die core 23 with a shape matching with the moving die core 33 are arranged on a side of the fixed die frame 21 facing the moving die module 3. The fixed die frame 21 is also provided with a feed port 212 for communicating with a discharge end of the die-casting machine, and the feed port 212 communicates with the pouring sleeve 22.

Referring to FIGS. 6 and 7, a fixed die cavity 231 is arranged on a side of the fixed die core 23 facing the moving die module 3. On the fixed die core 23, a fixed die acceleration portion 232 is arranged on a side of the fixed die cavity 231 close to the pouring sleeve 22. The fixed die accelerating portion 232 protrudes towards the moving die module 3, and descends first and then goes up in the pouring direction. A fixed die accelerating groove 2321 is formed on a side of the fixed die acceleration portion 232 facing the fixed die cavity 231.

Referring to FIGS. 6 and 7, on the fixed die core 23, a fixed die gate portion 233 is arranged on a side of the fixed die accelerating portion 232 facing the fixed die cavity 231. The shape of the fixed die gate portion 233 fits to the shape of the moving die gate portion 333. A plurality of fixed die ingate notches 2331 are arranged on the fixed die gate portion 233, which communicate with the fixed die accelerating groove 2321 and the fixed die cavity 231, and the fixed die ingate notches 2331 are in one-to-one correspondence with the moving die ingate notches 3331.

Referring to FIGS. 2 and 6, on the fixed die core 23, a fixed die limit slot 234 is arranged on a side of the fixed die cavity 231 away from the fixed die gate portion 233. The fixed die limit slot 234 communicates with the fixed die cavity 231. The fixed die frame 21 is provided with a fixed die sliding slot 213 corresponding to and communicating with the fixed die limit slot 234. When the fixed die module 2 and the moving die module 3 are clamped together, the fixed die cavity 231 and the moving die cavity 334 constitute a molding cavity, the fixed die limit slot 234 and the moving die limit slot 335 constitute a molding cavity limit slot communicating with the molding cavity, the fixed die sliding slot 213 and the moving die sliding slot 314 constitute a die sliding slot communicating with the molding cavity limit slot, and the sliding table 4 slides in the die sliding slot and drives the limiting table 41 to abut against the molding cavity limit slot.

Referring to FIGS. 2 and 6, the fixed die frame 21 is provided with an oblique dowel pin 5. The oblique dowel pin 5 extends from the fixed die module 2 to the moving die module 3. One end of the oblique dowel pin 5 is inserted into the sliding table 4. When the fixed die module 2 and the moving die module 3 are clamped together, the sliding table 4 is fixed by the oblique dowel pin 5 so as to reduce the possibility that the sliding table 4 slides in the die sliding groove when the sliding table 4 is impacted by metal liquid pressure.

Referring to FIGS. 2 and 6, insertion slots 235 are provided on the fixed die core 23 at positions corresponding to the filter blocks 339 of the moving die module 3, which is used for the insertion and installation of the filter blocks 339 of the moving die module 3. The fixed die core 23 is also provided with a fixed die cooling through groove 236 that penetrates through the fixed die core 23. The fixed die frame 21 is provided with a fixed die cooling port 214 communicating with the fixed die cooling through groove 236. The fixed die cooling port 214 is used for the installation of a cooling device for use with the die-casting die. The cooling device may be a cold water circulation system or a cold air circulation system, as long as it can be used for cooling. By the fixed die cooling through groove 236, the fixed die cavity 231 of the fixed die core 23 can be cooled comprehensively and rapidly, so as to improve the effect of die casting.

Figure 8:
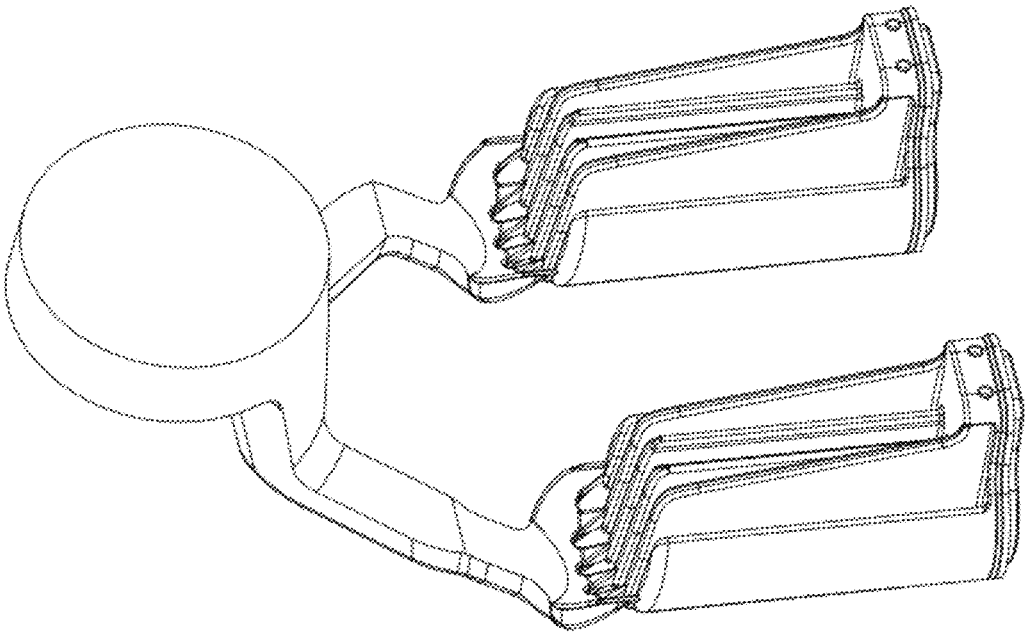
FIG. 8 is a schematic partial structural diagram of a metal die-casting blank manufactured by using the die-casting die according to Embodiment 1 of the present application, which mainly illustrates the shape and structure of the pouring runner, acceleration slot and ingate runner.

Referring to FIG. 8, when the fixed die module 2 and the moving die module 3 are clamped together, the sprue spreader frustum 321 on the sprue spreader 32 of the moving die module 3 is sleeved into the pouring sleeve 22 of the fixed die module 2. The sprue spreader 32 and the pouring sleeve 22 constitute a pouring portion of the die body 1. A annular runner formed by the pouring sleeve 22 and the sprue spreader frustum 321, the sprue spreader slot 322 on the sprue spreader frustum 321 and the moving die pouring runner 331 constitute a pouring runner of the die body 1. The fixed die accelerating portion 232 is arranged in the moving die accelerating cavity 332 to form the accelerating part of the die body 1, the fixed die accelerating groove 2321 and the moving die accelerating slot 3321 constitute the accelerating groove of the die body 1, the fixed die gate portion 233 and the moving die gate portion 333 constitute the gate portion of the die body 1, and the fixed die ingate notch 2331 and the moving die ingate notch 3331 constitute the ingate runner of the die body 1, the fixed die cavity 231 and the moving die cavity 334 constitute the molding cavity of the die body 1, and the communicating end between the ingate runner and the molding cavity is the ingate of the die body 1. The width of the ingate runner decreases gradually in the pouring direction.

Referring to FIG. 8, when the die-casting die is clamped for die casting, the molten metal liquid enters into the pouring sleeve 22 from the feed port 212 of the fixed die module 2, and is shunted by the sprue spreader frustum 321 at the sprue spreader 32. The shunted metal liquid flows through the corresponding sprue spreader slot 322. Specifically, the metal liquid successively flows through the sprue spreader slot 322, the moving die pouring runner 331, the acceleration slot and the ingate runner, and is injected into the molding cavity via the ingate under a high pressure. After the molding cavity is filled with the metal liquid, the metal liquid may overflow into the overflow groove 337 communicating with the molding cavity. The interior of the die-casting die can be vacuumized through the vacuum hole 336 to reduce the pore defects after metal liquid molding. In vacuumizing, the air flow is guided by means of the exhaust groove 338 communicating with the overflow groove 337 to reduce the flow channeling of metal liquid. The filter block 339 of the exhaust groove 338 is used for air ventilation and metal liquid interception to reduce the blockage of the vacuum hole 336. The metal liquid in the molding cavity is cooled and molded by means of the fixed die cooling port 214, the fixed die cooling through groove 236, the moving die cooling port 315 and the moving die cooling communicating groove 3310.

In this embodiment, the fixed die core 23 and the moving die core 33 are made of a high temperature resistant nickel base alloy material with strengthening by solid solution of tungsten and molybdenum and with grain boundaries strengthening by boron, cerium and chromium, which have high hardness and high temperature resistance. The fixed die gate portion 233 of the fixed die core 23 and the moving die gate portion 333 of the moving die core 33 are coated with anti-corrosion coatings respectively, for example, an AlCrN coating. The surface hardness of the fixed die gate portion 233 and the moving die gate portion 333 reaches 3500 HV, which enhances the erosion resistance of the fixed die gate portion 233, the moving die gate portion 333, and the gate of the die body 1.

The section shape of the ingate in die body 1 facing the molding cavity may be circular or rectangular, which may be determined according to the structural characteristics of the metal die castings that can be molded in the molding cavity. Referring to FIG. 8, in this embodiment, the section shape of the ingate facing the molding cavity is rectangular. In this embodiment, the length and width of the section shape of the ingate facing the molding cavity are 3.4 mm and 2.4 mm, that is, the section area of the ingate facing the molding cavity is $S_{pouring}$=3.4 mm×2.4 mm=8.16 mm$^2$. At the same time, there are multiple ingates on the die body 1, that is, N ingates. Specifically, a sprue spreader slot 322 corresponds to a pouring runner, a pouring runner corresponds to an acceleration portion, an acceleration portion corresponds to a gate portion, a gate portion corresponds to a molding cavity, and six ingates are arranged on one gate portion for communicating with the molding cavity. In an embodiment, two gate portions and two molding cavities are provided on the die body 1, that is, twelve ingates are provided, that is, N=12. Therefore, in this embodiment, the total sectional area of the gate of the die body 1 is $S_{total\text{-}pouring}=N\times S_{pouring}=12\times 8.16\ mm^2=98\ mm^2$.

Embodiment 2

Figure 9:
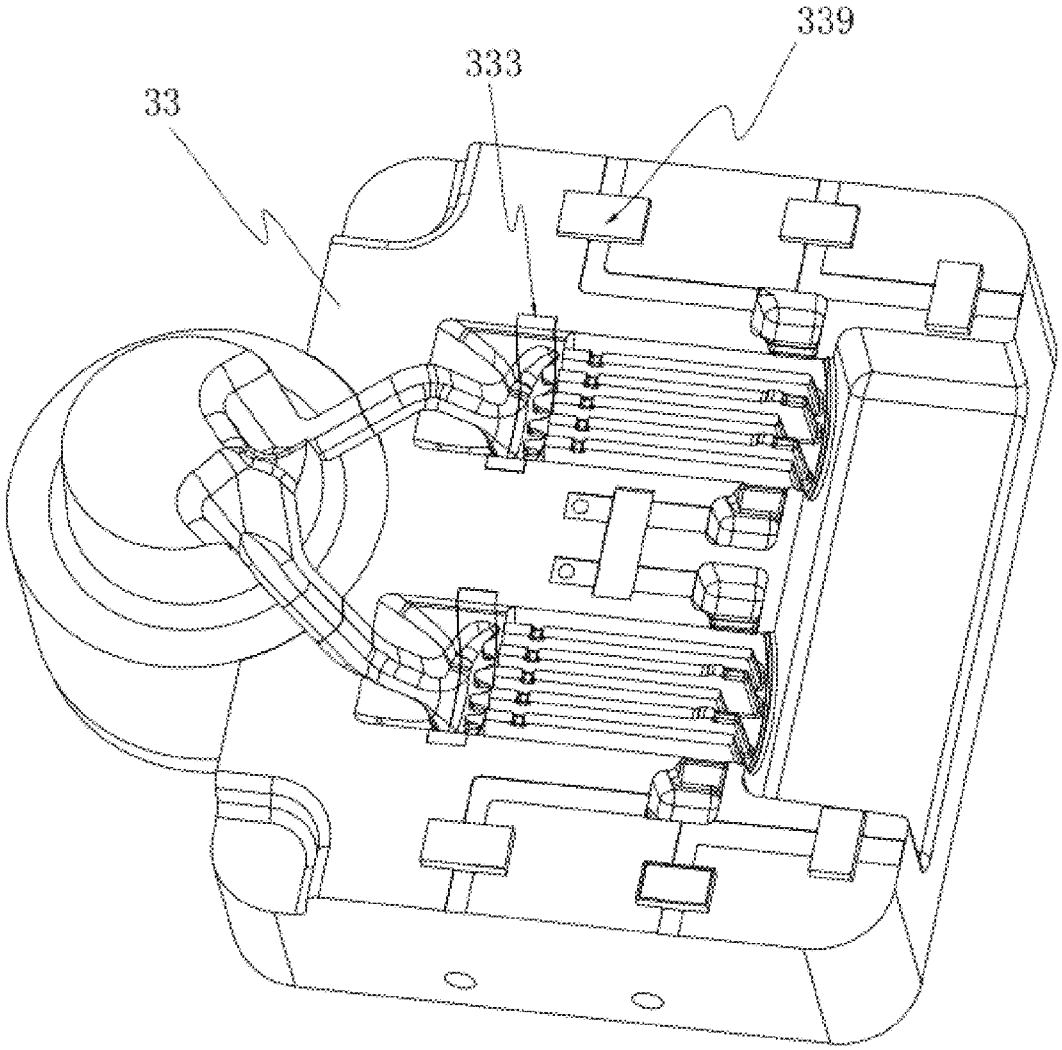
FIG. 9 is a schematic structural diagram of a moving die core according to Embodiment 2 of the present application.
Figure 10:
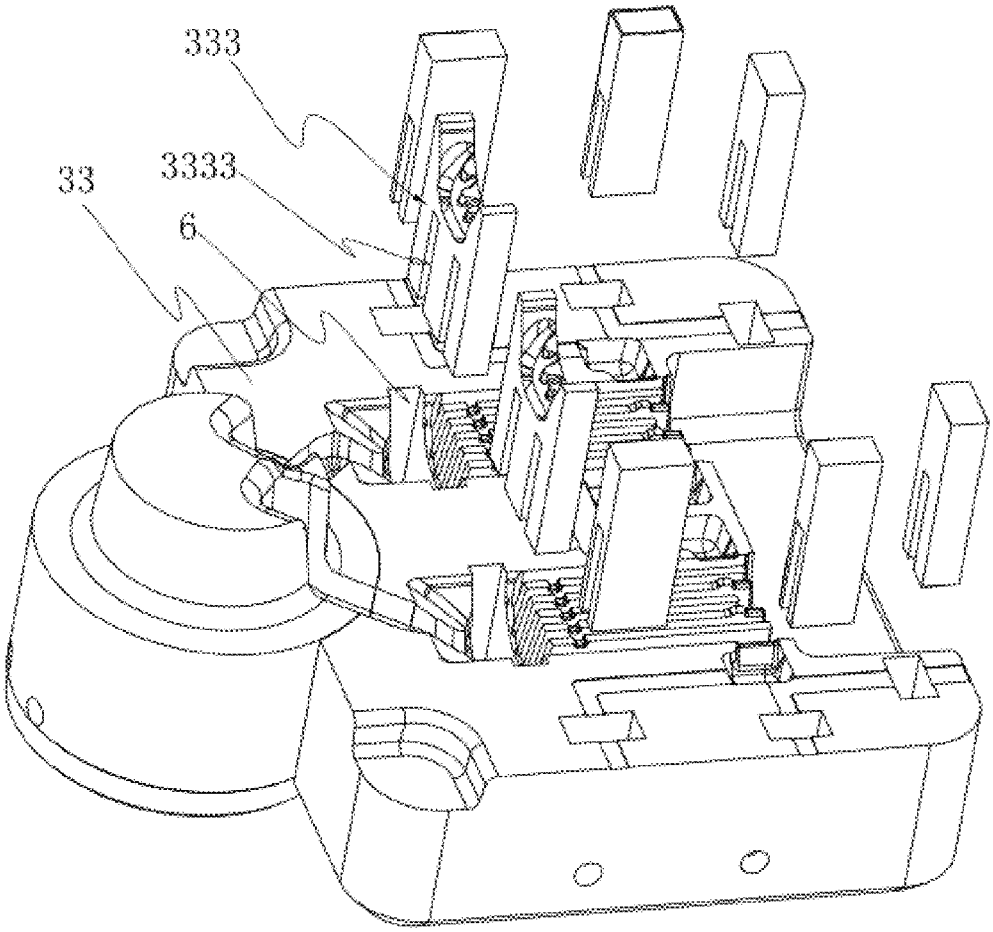
FIG. 10 is a schematic structural exploded diagram of the moving die core according to Embodiment 2 of the present application.
Figure 11:
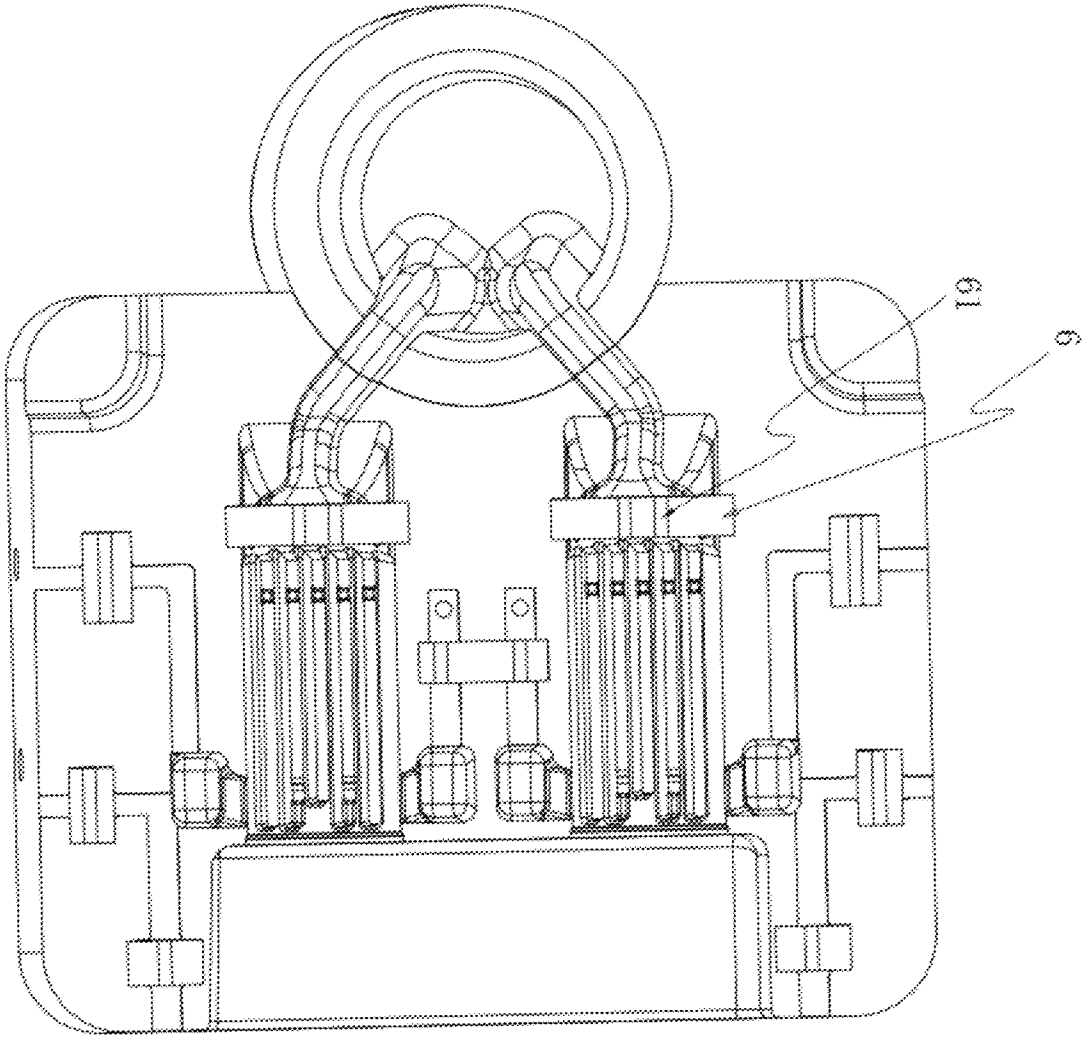
FIG. 11 is a schematic structural diagram of the moving die core in an unassembled state according to Embodiment 2 of the present application.

Referring to FIG. 9, 10 and 11, a die-casting die is provided according to Embodiment 2. The die-casting die of Embodiment 2 is different from Embodiment 1 in that:

the moving die gate portion 333 of the moving die module 3 is detachably arranged on the moving die core 33, and the fixed die gate portion 233 of the fixed die module 2 is detachably arranged on the fixed die core 23. Specifically, a gate mounting slot 6 is provided on the moving die core 33, a positioning block 61 is arranged in the gate mounting slot 6, and the positioning block 61 protrudes from the bottom of the gate mounting slot 6. A positioning groove 3333, corresponding to the positioning block 61, is provided on a side of the moving die gate portion 333 facing the moving die core 33. In installation, the moving die gate portion 333 is placed in the gate mounting slot 6, the positioning groove 3333 fits to the positioning block 61, the positioning block 61 is inserted into the positioning groove 3333, and the positioning block 61 positions and guides the moving die gate portion 333, to reduce the displacement phenomenon when the moving die gate portion 333 is embedded into the gate mounting slot 6, and improve the stability of embedded installation and installation. It should be noted that, a plurality of positioning blocks 61 may be provided, and the number of the positioning grooves 3333 is consistent with the number of the positioning blocks 61. The number of positioning blocks 61 can be determined according to requirements for the size of the moving die gate, in order to implement stable positioning, guide and installation. Moreover, in order to improve the installation stability, an installation through-hole (not shown in the drawing) may also be provided on a side of the moving die core 33 away from the gate mounting slot 6, which communicates with the gate mounting slot 6. A threaded hole is provided on the moving die gate portion 333 at a position corresponding to the installation through-hole. With communicating of the installation through-hole with the threaded hole, the moving die gate portion 333 may be further installed and fixed by using fixing parts such as screws. The detachable mounting structure of the fixed die gate portion 233 and the fixed die core 23 is the same as that of the moving die gate portion 333 and the moving die core 33. The moving die gate portion 333 and the fixed die gate portion 233 may be replaced by means of such a detachable installation. The moving die gate portion 333 and the fixed die gate portion 233 are made of a high temperature resistant nickel base alloy material with strengthening by solid solution of tungsten and molybdenum and with grain boundaries strengthening by boron, cerium and chromium, which have high hardness and high temperature resistance.

The filter block 339 is detachably arranged on the moving die core 33. The detachable mounting structure of the filter block 339 and the moving die core 33 is the same as that of the moving die gate portion 333 and the moving die core 33. The filter block 339 may be replaced by means of such a removable installation. The filter block 339 is a microporous metal sintered block. The microporous metal sintered block is a metal material block with ventilation micropores by cold pressing, sintering and heat treatment of metal powder.

Embodiment 3 a die-casting device includes a die-casting machine and a die-casting die according to Embodiment 1.

The die-casting machine includes a clamping mechanism for driving the die-casting die to be opened and clamped and an injection mechanism for injecting metal liquid into the die-casting die at a specified speed.

The clamping mechanism includes a fixed die mounting plate, a moving die mounting plate, and a driving-clamping device for driving the moving die mounting plate to move towards or away from the fixed die mounting plate. The fixed die module of the die-casting die is installed on the fixed die mounting plate by the fixed die frame, and the moving die module of the die-casting die is installed on the moving die mounting plate by the moving die frame.

The injection mechanism includes a barrel, a punch pin arranged in the barrel, and a pushing device for pushing the punch pin. The barrel is provided with a feed end for feeding the metal liquid and a discharge end for discharging the metal liquid. The punch pin is used to push the metal liquid. The feed port of the fixed die module of the die-casting die communicates with the discharge end of the barrel. The barrel is made of titanium alloy ceramic material, and the thermal conductivity of the barrel is 7.4 W/mk. The barrel with low thermal conductivity helps to keep the metal liquid at high temperature before entering the die-casting die.

In the process of die casting, $S_{punch} \times V_{punch} = S_{total\ pouring} \times V_{pouring}$, in which $V_{pouring}$ is a gate speed of the ingate, $S_{punch}$ is a cross-sectional area of the punch pin of the die-casting machine facing the pushing direction, and $V_{punch}$ is a pushing speed of the die-casting machine. Therefore, the gate speed of the die-casting die in the process of die casting, $V_{pouring} = S_{punch} \times V_{punch} / S_{total\ pouring}$.

In this embodiment, the punch pin diameter of the punch pin in the barrel is 60 mm, and the punch pin area $S_{punch} = \pi R^2 = \pi \times 30^2 \approx 2827\ mm^2$. If the pushing speed of the punch pin is arranged as $V_{punch} = 3.2$ m/s. Then in this embodiment, the gate speed of the die-casting die is $V_{pouring} = S_{flushing} \times V_{flushing} / S_{total\ pouring} = 2827 \times 3.2/98 \approx 92$ m/s. In this embodiment, the gate speed of the die-casting die can reach 92 m/s, and the die-casting device in this embodiment can carry out ultra-high speed die casting.

The gate speed of the die-casting device can reach 92 m/s, so that the metal liquid can be sprayed into the molding cavity in the form of atomization. The residual air in the molding cavity is broken into micro fine bodies to fully compress the pores of the metal forming parts obtained by die casting. The pore volume ratio is compressed to 0.01%, to homogenize the metallographic structure and improve the forming effect of the metal parts. It is especially convenient to make metal products with high requirements such as porosity less than 0.2%, dense surface and high finish, or T6 treatment.

Embodiment 4 an ultra-high speed die casting method by using the die-casting device according to Embodiment 3, including the following steps:

preheating the die-casting die and controlling the die-casting die temperature to 220-230° C.;

pouring the molten magnesium alloy metal liquid into the barrel of the die-casting machine, and the pushing speed of the punch pin is 0.7 m/s; vacuumizing the die-casting die when the punch pin is pushed to block the feeding end of the barrel; at the same time, continuing to push the metal liquid to fill the gate portion of the preheated die-casting die; in this process, the pushing speed of punch pin starts from 0 m/s and gradually increases to 0.7 m/s; it should be noted that, the pushing speed may also be directly set to 0.7 m/s, the pushing speed of 0.7 m/s may be maintained continuously during the process. In this embodiment, the setting of increasing from 0 m/s to 0.7 m/s is adopted;

increasing the pushing speed of the punch pin instantly when the metal liquid is filled into the gate portion of the preheated die-casting die; the pushing speed of the punch pin is 3.2 m/s, so that the gate speed of the ingate of the gate portion reaches 92 m/s; pushing the metal liquid to spray the metal liquid into the molding cavity from the gate portion in a form of atomization;

after filling the molding cavity, reducing the pushing speed of the punch pin and pressurizing the die-casting machine to 100 MPa;

cooling, molding and demoulding to obtain a required metal die casting.

In particular, the moment of the metal liquid reaching the gate portion of the die-casting die or the metal liquid filling the molding cavity can be determined by the existing general pouring simulation software in the technical field, combined with the simulation conversion of die-casting die parameters, die-casting machine barrel parameters, stamping parameters and metal liquid quality parameters.

The ultra-high speed die casting method adopts the method of instantaneous pressurization and filling to reduce the pressure loss in the early stage, to improve the direct effect of pressure at the gate portion, the pressure effect of metal liquid injecting into the molding cavity from the ingate of the gate portion and the gate speed, to achieve the effect of ultra-high speed atomization and filling.

Figure 12:
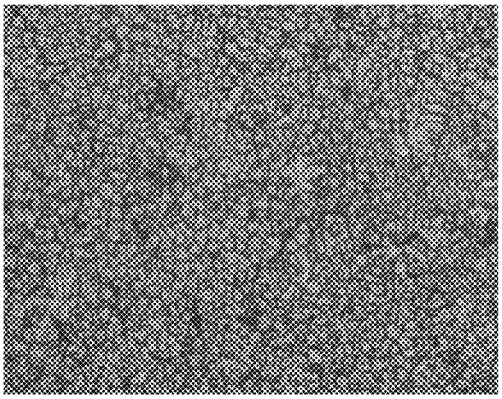
FIG. 12 is a SEM diagram of a metal casting obtained according to Embodiment 4 of the present application.

Referring to FIG. 8, the obtained metal casting is a multi-blade heat sink with a blade thickness of 0.8 mm The SEM diagram of the metal casting obtained in Embodiment 4 is shown in FIG. 12, which has good forming effect, uniform metallographic structure, few pore defects, no surface streamline trace and small grains.

Embodiment 5

Figure 13:
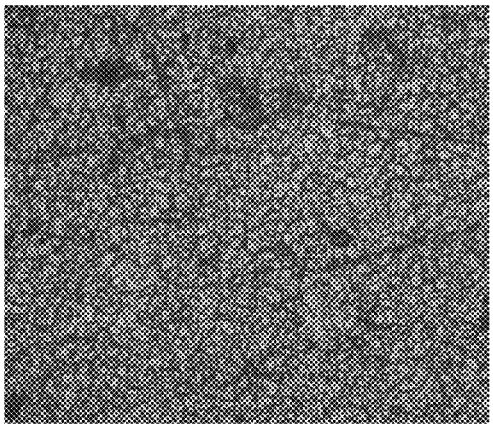
FIG. 13 is a SEM diagram of a metal casting obtained according to Embodiment 5 of the present application.

Embodiment 5 differs from Embodiment 4 is in the gate speed of the die-casting die during die-casting. In Embodiment 5, the cross-sectional area of the ingate of the die-casting die facing the molding cavity is $S_{pouring}$=11.60 mm$^2$, the total gate cross-sectional area is $S_{pouring}$=N×$S_{pouring}$=12×11.60 mm$^2$=139.2 mm$^2$, and the gate speed of the die-casting die is $V_{pouring}$=$S_{punch}$×$V_{punch}$/$S_{total\ pouring}$=2827×3.2/139.2≈65 m/s. The SEM diagram of the metal casting obtained in Embodiment 5 is shown in FIG. 13, which has good forming effect, uniform metallographic structure, few pore defects, less surface streamline trace and small grains.

Embodiment 6

Figure 14:
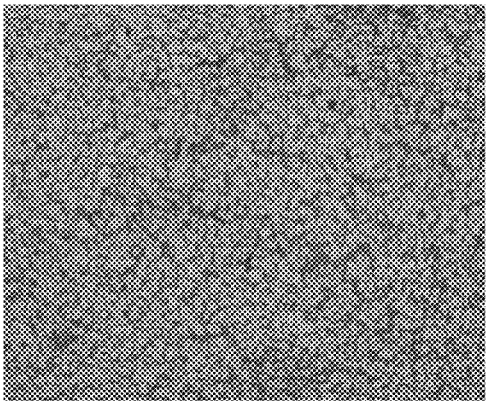
FIG. 14 is a SEM diagram of a metal casting obtained according to Embodiment 6 of the present application.

Embodiment 6 differs from Embodiment 4 is in the gate speed of the die-casting die during die-casting. In Embodiment 6, the cross-sectional area of the ingate of the die-casting die facing the molding cavity is $S_{pouring}$=6.85 mm$^2$, the total gate cross-sectional area is $S_{pouring}$=N×$S_{pouring}$=12×6.85 mm$^2$=82.2 mm$^2$, and the gate speed of the die-casting die is $V_{pouring}$=$S_{punch}$×$V_{punch}$/$S_{total\ pouring}$=2827×3.2/82.2≈110 m/s. The SEM diagram of the metal casting obtained in Embodiment 6 is shown in FIG. 14, which has good forming effect, uniform metallographic structure, few pore defects, no surface streamline trace and small grains.

The above are the preferred embodiments of the present application and do not limit the scope of protection of the present application. Therefore, all equivalent changes made according to the structure, shape and principle of the present application shall be covered by the scope of protection of the present application.

What is claimed is:

1. A die-casting die, comprising:

a die body, wherein:

the die body is provided with a feed port, a pouring portion and a cavity portion, the pouring portion is provided with a pouring runner communicating with the feed port, the cavity portion is provided with a molding cavity, a gate portion is provided between the cavity portion and the pouring portion of the die body, the gate portion is provided with a plurality of ingate runners communicating with the molding cavity and the pouring runner, the plurality of ingate runners are arranged in sequence in a width direction of a side of the gate portion facing the molding cavity, ends of the plurality of ingate runners at which the plurality of ingate runners communicate with the molding cavity constitute an ingate, a diameter of each of the plurality of ingate runners is gradually reduced in a pouring direction, an acceleration portion is provided between the pouring portion and the gate portion of the die body, the acceleration portion is provided with an acceleration slot that communicates with the pouring runner and the plurality of ingate runners, the acceleration slot first descends and then goes up along the pouring direction, so that a metal liquid forms a U-shaped communicating portion in the pouring direction, there is no horizontal section in the acceleration slot and two ends of the acceleration slot are equal in height, the plurality of ingate runners comprise N ingate runners, a cross-sectional area of each ingate facing the molding cavity is $S_{pouring}$, $S_{pouring}$ is configured to equal to ($S_{punch}$×$V_{punch}$)/(N×$V_{pouring}$), $S_{punch}$ is a cross-sectional area of a punch pin facing a pushing direction, $V_{punch}$ is a pushing speed of the punch pin, $V_{pouring}$ is a gate speed of the ingate of the die-casting die, $V_{pouring}$ is 65-120 m/s, an overflow groove is provided on one end of the molding cavity of the die body away from the ingate, the overflow groove communicates with the molding cavity, the die body is provided with an exhaust groove in communication with the overflow groove, a filter block is provided on an exhausting path of the exhaust groove, the filter block is located between a vacuum hole and the overflow groove, the filter block is a microporous metal sintered block, and the filter block is detachably arranged on the die body.

2. The die-casting die according to claim 1, wherein the gate portion is detachably arranged on the die body.

3. The die-casting die according to claim 1, wherein the gate portion is made of nickel base alloy material.

4. The die-casting die according to claim 1, wherein a side wall of each of the plurality of ingate runners is coated with an anti-corrosion coating, which is an AlCrN coating.

5. A die-casting device, comprising: a die-casting machine and the die-casting die according to claim 1, wherein the die-casting machine comprises an injection mechanism for pushing the metal liquid into the die-casting die at a specified speed; the injection mechanism comprises a barrel and the punch pin arranged in the barrel; the barrel is provided with a feed end for feeding the metal liquid and a discharge end for discharging the metal liquid; the punch pin is configured for pushing the metal liquid; the feed port of the die-casting die communicates with the discharge end of the barrel.

6. The die-casting device according to claim 5, wherein a thermal conductivity of the barrel is lower than 8 W/mk.

7. An ultra-high speed die-casting method for die casting with the die-casting device according to claim 5, comprising:

preheating the die-casting die;

pouring the metal liquid into the barrel of the die-casting machine, and the pushing speed of the punch pin is less than 0.7 m/s; vacuumizing the die-casting die when the punch pin is pushed to block the feed end of the barrel; at the same time, continuing to push the metal liquid to fill the gate portion of the die-casting die;

increasing the pushing speed of the punch pin instantly when filling the metal liquid into the gate portion of the die-casting die, the pushing speed of the punch pin of the die-casting machine is 1-8 m/s;

pushing the metal liquid to spray the metal liquid into the molding cavity from the gate portion in a form of atomization;

after filling of the molding cavity is completed, reducing the pushing speed of the punch pin and pressurizing the die-casting machine to 70-100 MPa; and cooling, molding and demoulding to obtain a required metal die casting.

* * * * *